United States Patent [19]

Kalmanides

[11] Patent Number: 4,886,204

[45] **Date of Patent: * Dec. 12, 1989**

[54] FOOD CONTAINER WITH RIBBED LID LOCKING MECHANISM

[75] Inventor: Danny Kalmanides, Orange, Conn.

[73] Assignee: Inline Plastics Corporation, Milford, Conn.

[ * ] Notice: The portion of the term of this patent subsequent to Sep. 20, 2005 has been disclaimed.

[21] Appl. No.: 211,438

[22] Filed: Jun. 24, 1988

Related U.S. Application Data

[63] Continuation-in-part of Ser. No. 34,616, Apr. 6, 1987, Pat. No. 4,771,934.

[51] Int. Cl.[4] ..... B65D 1/34

[52] U.S. Cl. ..... 229/2.5 R; 24/702; 206/470; 220/306

[58] Field of Search ..... 229/2.5 R; 220/306, 220/339, 4 B; 206/461, 470; 24/700–702

[56] References Cited

U.S. PATENT DOCUMENTS

| | | | |
|---|---|---|---|
| 3,685,717 | 8/1972 | Sarferth et al. | 229/2.5 R X |
| 3,786,982 | 1/1974 | Rakes et al. | 229/2.5 R |
| 3,933,296 | 1/1976 | Rusken et al. | 229/2.5 R |
| 4,225,077 | 9/1980 | Verfinger | 229/2.5 R |
| 4,354,816 | 10/1982 | Schepp . | |
| 4,382,762 | 5/1983 | Schepp . | |
| 4,423,811 | 1/1984 | Knapp | 206/470 X |
| 4,512,474 | 4/1985 | Harding | 220/306 X |
| 4,576,330 | 3/1986 | Schepp . | |
| 4,771,934 | 9/1988 | Kalmanides | 229/2.5 R |

FOREIGN PATENT DOCUMENTS

| | | | |
|---|---|---|---|
| 6607668 | 12/1966 | Netherlands | 229/2.5 R |
| 2118142 | 10/1983 | United Kingdom | 229/2.5 R |

OTHER PUBLICATIONS

Technical Report, Case No. L–19035, prepared by Skinner & Sherman Laboratories, Inc., Feb. 2, 1987.

Mechanical Drawing of Inline Plastics Corporation, Milford, Conn., prepared Jun. 24, 1987.

*Primary Examiner*—Bryon P. Gehman

*Attorney, Agent, or Firm*—Kramer, Brufsky & Cifelli

[57] ABSTRACT

More facile closure of a food tray having a lid portion, a tray portion, cylindrical female locking elements disposed about a peripheral flange of the lid portion and cylindrical male locking elements disposed about a peripheral flange of the tray portion is accomplished by providing the female elements with axial ribs that both stiffen the female element with respect to closing pressure applied thereto and allow otherwise entrapped air within the female element to escape during insertion of the male element. Raised lands disposed about the peripheral flange of the lid portion adjacent the female elements act to divert a portion of the closing pressure applied, e.g., by a user's thumb, away from the closed end of the female element, thereby limiting deformation of the female element. A concave end surface of the female element also acts to alleviate deformation thereof. These various features are advantageously used either alone, or in concert with one another.

15 Claims, 4 Drawing Sheets

FOOD CONTAINER WITH RIBBED LID LOCKING MECHANISM

This is a continuation-in-part of commonly owned U.S. Pat. No. 4,771,934, filed Apr. 6, 1987.

BACKGROUND OF THE INVENTION

1. Field of the Invention

This invention relates to a plastic food tray, and more particularly, a tray with a lid or cover which is lockable to the tray.

2. Description of the Prior Art

Food has been sold by "fast-food" restaurants in carry-out containers consisting of a thermoformed plastic tray provided with a hinged lid. The lid includes a flange which has been heretofore seated in snap arrangement with a horizontal flange integrally molded about the rim portion of the food-carrying tray. Attempts to hold the lid in a closed position on the flange about the rim portion of the tray while maintaining the ability to repeatedly open and close the tray without any degradation to the locking mechanism, have generally proved unsuccessful.

Such attempts have taken the form of providing an upstanding or vertical wall about the perimeter or periphery of the horizontal flange on the rim portion of the tray wherein the distance between opposed portions of the upstanding wall has been slightly less than the distance between corresponding portions of the mating flange on the lid so that the flange on the lid is engaged between opposed portions of the vertical wall on the perimeter of the horizontal tray flange in tight, interference fit. Because of the resiliency inherent in the hinge attaching the lid to the tray, this technique has enjoyed limited success. Further, because of the materials, such as plastic, used to form the tray, the distances between opposite portions of the upstanding wall and corresponding portions of the horizontal flange on the lid have been imprecise, therefore failing to effect a tight fit of the lid between opposite portions of the upstanding wall.

In order to remedy this, interlocking upright cylindrical elements have been formed on the horizontal flanges of the lid and tray. However, imprecision in the formation of the interlocking cylindrical elements and the inherent resiliency in the hinge of the lid prevented this from being a satisfactory mass-produced locking mechanism.

U.S. Pat. No. 4,576,330, issued to Schepp and having a common assignee as the instant invention, discloses a folding plastic food tray with interlocking male and female elements formed, respectively, on the horizontal flanges of the tray and lid. A snap, reversible locking engagement is realized by providing the male element with an enlarged diameter portion at its closed top end which is received in snap engagement past a smaller diameter annular rim formed in the opening to the bore of the female element. This configuration, however, has proven somewhat unsatisfactory in that in order to engage the male and female elements in snap, reversible locking engagement, one must press directly upon the male and female elements. In both this particular design and any other design using interlocking male and female elements, this pressure on the cylindrical elements may cause these elements, most notably the female element, to deform, thereby degrading the reliability of the locking arrangement. This deformation of the elements may result from repeated closing and opening of the tray, or may be due to minor misalignment of the elements immediately prior to engagement.

It is therefore an object of the present invention to provide a means whereby various designs of interlocking male and female elements, not limited to the above-described design of the Schepp patent, for interlocking the lid to a food tray are less susceptible to deformation in the engaging of this interlocking arrangement. This allows the repeated engagement and disengagement of the interlocking arrangement without any degradation thereto, and facilitates engagement of the interlocking elements despite minor misalignments during the engagement process. Such minor misalignments are inevitable with a folding lid design.

SUMMARY OF THE INVENTION

The present invention provides an apparatus whereby a food tray may have a folding lid secured thereto by the use of male and female interlocking upright cylindrical elements but without the degradation of the interlocking mechanism due to the repeated locking and unlocking thereof.

One or more upright cylindrical female elements are formed at appropriate locations about the periphery of the lid. Interlocking upright cylindrical male elements are formed about the periphery of the tray in locations in which they extend into the upright cylindrical female elements when the lid is in a closed position over the tray.

According to the invention, ribs are formed about the substantially cylindrical side wall of each female element and extend axially (longitudinally) substantially from the open end of the female element to the opposite, closed end thereof. These ribs form axial ridges on the outside surface of the female element and provide additional axial strength to the female element so that it is less likely to deform as a result of pressure applied to the female element to close the tray. The ribs also form channels along the inside surface of the female elements so that air will not be entrapped in the female element as a result of the male element being inserted therein, the outside, mating surface of the male element being substantially cylindrical.

In a preferred embodiment of the invention which is shown in the accompanying drawings hereto, eight semicircular ribs are evenly distributed about each female element, and the diameter of each rib is a fraction, such as 1/10 of the diameter of the female element. The channels thus formed on the inside surface of the female element negligibly attenuate, on the order of 20± 5%, the contact surface with the male element.

According to a further aspect of the invention, the opposite, closed end surface of the female element is indented, or concave, so that closing pressure, such as would be applied by a user's thumb, tends to be more directly applied to the side walls of the female element, rather than to the center of the closed end surface. This tends to alleviate deformation of the female element which may result from pressure applied to the center of the closed end surface. The indented closed end surface of the element, if employed without the benefit of the ribs, offers an additional advantage of being able to expand outwardly when insertion of the male element tends to trap air within the female element, thereby facilitating the snap engagement of the male and female members.

In order to further assist the user in snapping together male elements into the female elements, without deformation of the female element, lands or raised areas are formed on the lid adjacent the cylindrical female element and extend to approximately the height of the female cylindrical elements. This allows the user to push on these lands in lieu of or in combination with the upright cylindrical female elements when closing the lid, thereby limiting deformation and preserving the shape, resiliency and functionality of the interlocking cylindrical female elements.

In order to close the tray, that is to lock the lid to the tray, the tip of the upright cylindrical male element is directed into the bore of the corresponding upright cylindrical female element. This may be effected by a user placing his forefinger under the upright cylindrical male element on the periphery of the trap. Then he places his thumb over the lands, possibly in combination with the upright cylindrical female elements on the lid and presses his thumb and forefinger together thereby interlocking the upright cylindrical elements one to another. If the user presses on a combination of the interlocked elements and lands, the depth of depression of the thumb and hence, the interlocked elements, is limited by contact with the lands, thereby preserving the integrity of the interlocking elements for repeated use.

The present invention provides a one-piece plastic thermoformed food tray with a lower tray portion which may be closed by an upper lid portion. The lid portion is locked over the tray portion by the interlocking of interior upright cylindrical elements formed from a flange about the periphery of the tray portion into exterior upright cylindrical elements formed from a flange about the periphery of the tray portion. Raised lands are provided adjacent the exterior upright cylindrical elements in order to protect the same from pressure and subsequent degradation and deformation during the interlocking process by limiting the depth of depression with the thumb of the interlocking cylindrical elements.

The combination of ribs, lands and the indented end surface results in an astonishing improvement in function over the aforementioned U.S. Pat. No. 4,576,330.

It should be understood that no particular significance should be attached to the female elements and their associated lands being disposed about the periphery of the "lid", or upper portion of the container and the male elements being disposed about the periphery of the "tray", or lower portion of the container. The entire container is readily used "upside down", in which case any references made herein, including the claims, to the "lid" portion would apply to the lower portion of the container and any references made to the "tray" portion would apply to the upper portion of the container. References to "upright" would, in that case, be read as "downward facing".

Similarly, in any description of a user closing the container, it is typical that the thumb is applied to the relevant elements(s) on the upper portion of the tray and the first two fingers are applied to the relevant element(s) on the lower portion of the tray.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 6:
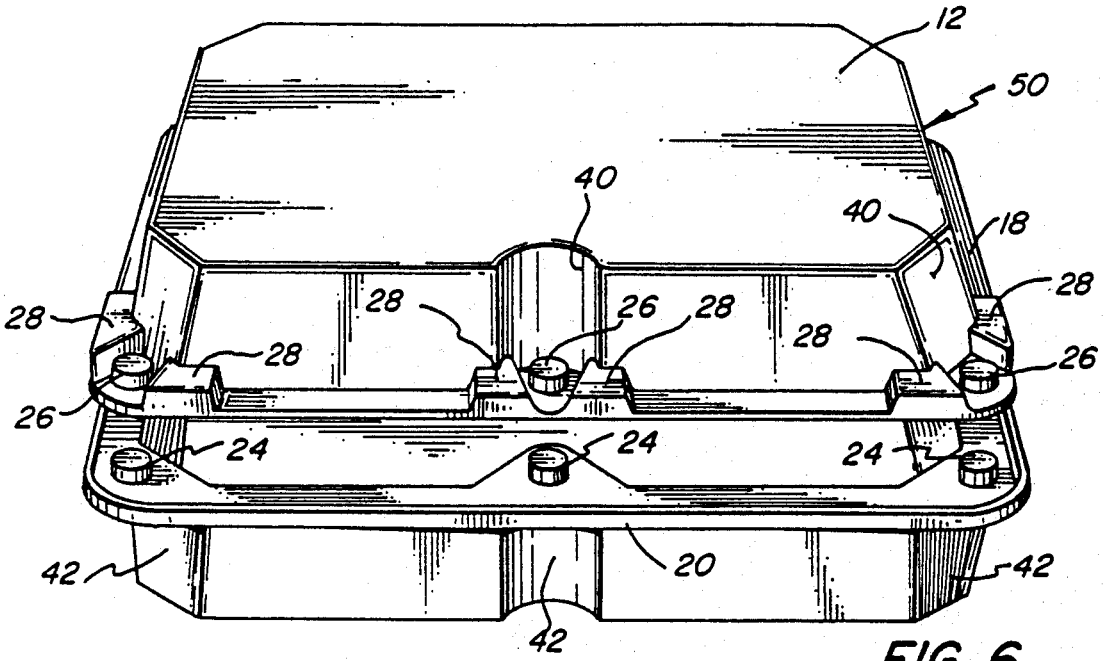
FIG. 6 is a perspective view of another form of food tray of the present invention.
Figure 3:
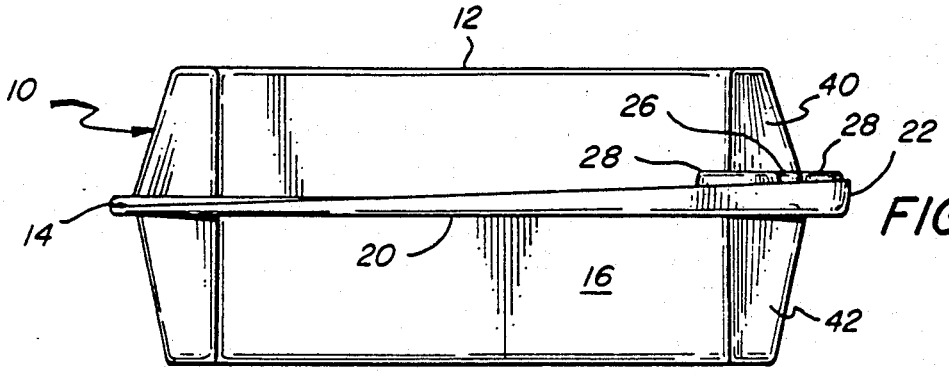
FIG. 3 is a side plan view of the lidded food tray of FIG. 1 after it has been closed and locked as seen from the left-hand side of FIG. 2.
Figure 4:
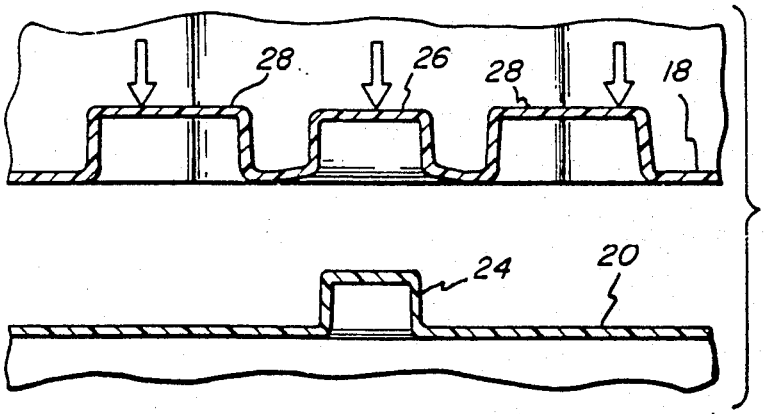
FIG. 4 is a cross-sectional view taken substantially along the plane indicated by line 4—4 of FIG. 2.

Referring now to the drawings in detail wherein like numerals indicate like elements throughout the several views, one form of the food tray 10 of the present invention may be thermoformed by an apparatus and process illustrated and described in U.S. Pat. No. 4,382,762 issued on May 10, 1983 to Schepp, and is shown in FIGS. 1 to 5 and 7 to 9, inclusive. FIG. 6 shows an alternate embodiment of the food tray. In general, the food tray 10 is thermoformed in a mold cavity in one piece having a lid 12 hinged along a line 14 directly to a tray portion 16. Tray portion 16 and lid 12 are rectangular, preferably square, in plane elevation.

The lid 12 of the apparatus 10 is provided with a horizontal flange 18 around its periphery adapted to be seated on a horizontal flange 20 provided about the periphery of tray 16. Flange 20 is also provided with an upstanding lip 22, the distance between opposed positions thereof being less than the distance between corresponding portions of the horizontal flange 18 on lid 12 so that the lid can be held in place in a seated engagement on flange 20 when the lid is in position to close the bottom portions of tray 16.

Formed on opposing corners of the front portion of flange 20 is an upstanding hollow peg or upright cylindrical male element 24. The upright cylindrical male elements are adapted to be received in bores of upright cylindrical female elements 26 formed at corresponding locations on lid flange 18 in snap engagement to securely lock the lid 12 to the bottom portion of the apparatus or tray 16. The manner in which the male and female upright cylindrical elements 24, 26 are interlocked in snap engagement is disclosed in U.S. Pat. No. 4,576,330, which disclosure is incorporated herein by reference.

As discussed hereinbefore, the male element 24 may be provided with an enlarged diameter portion (shown at 28 in FIG. 6 of Pat. No. 4,576,330) at its closed top end which is received in snap engagement past a smaller diameter annular rim (shown at 32 in FIG. 6 of Pat. No. 4,576,330) formed in the opening to the bore of the female element 26. While such an arrangement is effective to provide a snap, reversible locking engagement between the locking elements, it tends to augment the pressure required to effect engagement of the locking elements.

As discussed hereinbefore, the application of pressure to the locking elements 24 and 26 to effect their engagement tends to deform, in particular, the female element 26. The deformation tends to begin at the closed end 74 of the female element where closing pressure may be applied, and propagates throughout the entire element. Therefore, the present invention is directed to improvements in the structure of the female element 26 which will make it more capable of withstanding the closing pressure, as well as to a modification of the lid flange which tends to divert closing pressure away from the closed end of the female element.

Adjacent to the upright cylindrical female elements 265 are raised portions or lands 28 about the periphery of the lid flange 18. These lands 28 are approximately the same height as the upright cylindrical female elements 26, and may have any shape convenient to the molding process. In the embodiment shown, the lands 28 are J and L-shaped in plan.

Figure 5:
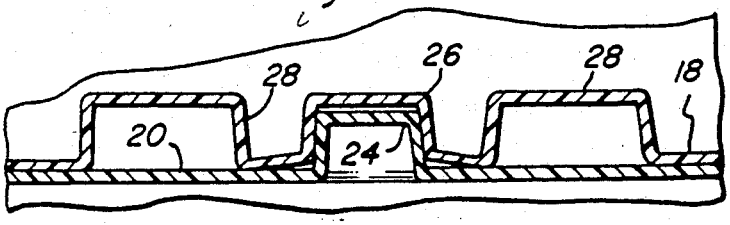
FIG. 5 is a view similar to FIG. 4 after the food tray has been closed and locked.

The body portion of the lid 12 and the corresponding body portion of the tray 16 adjacent to the corners of the lid 12 and the tray 16 may be provided with relieved arcuate surfaces 40 and 42, respectively. In an example of effecting snap engagement between the upright cylindrical male element 24 and the upright cylindrical female element 26, the surfaces 40 and 42 assist in guiding the thumb and forefinger of the hand, respectively, to cause engagement of the upright cylindrical male element 24 within the corresponding upright cylindrical female element 26 in the lid 12 by applying simultaneous pressure between the thumb and forefinger to the lands 28 and the top of an adjacent upright cylindrical female element 26, as shown by the arrows in FIG. 4, causing each upright cylindrical female element 26 to receive upright cylindrical male element 24 in snap engagement, as shown in FIG. 5. For purposes of illustration, surfaces 40 and 42 are shown as arcuate surfaces. However, those skilled in the art will realize that a variety of shapes in these indented surfaces 40 and 42 are practical.

When one wants to lock the lid 12 over the tray 16, one inserts all upright cylindrical male elements 24 into their corresponding upright cylindrical female elements 26. He places his thumb over the upright cylindrical female elements 26 and the raised lands 28 and his forefinger at a position on the horizontal flange 20 under an upright cylindrical male element 24. He then squeezes his thumb and forefinger together, thereby engaging the upright cylindrical male and female elements 24, 26 into snap engagement. As the user presses on a combination of the female elements 26 and raised lands 28, the closing pressure to which the closed end of the female element would otherwise be subjected is preferably distributed to the lands. However, in practice this is not always the case. Hence, depth of depression of the thumb into the interlocked male and female elements 24, 26 is limited by contact with the raised lands 28. This prevents the deformation of the male and female elements 24, 26, particularly the female elements 26, thereby increasing the durability, reusability and lifetime of the locking mechanism of the food tray 10.

Tray 50, shown in FIG. 6, has a similar locking mechanism to that of tray 10, the same numerals indicating the same elements. The tray 50, however, is larger than tray 10, being rectangular rather than square, and has a center, as well as end interlocking, snap closure elements 24, 26 with adjacent lands 28.

Figure 7:
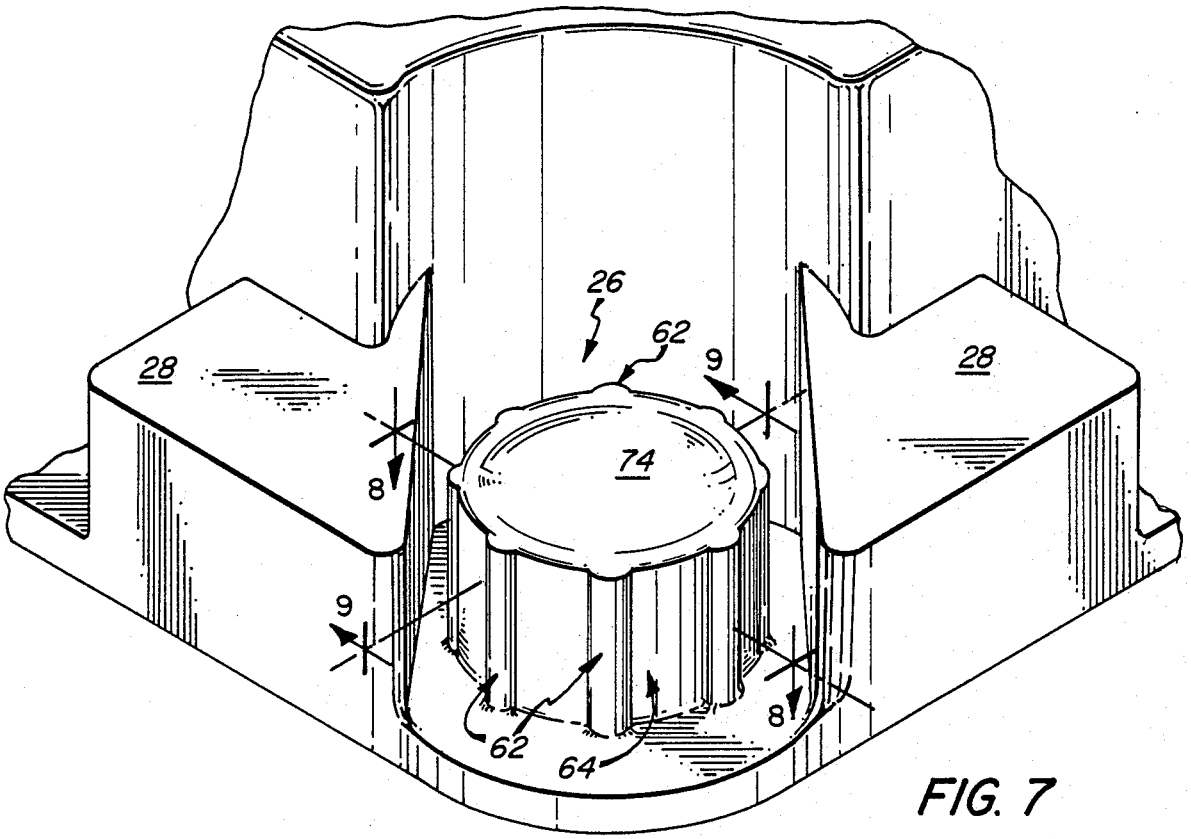
FIG. 7 is a perspective view of a corner of the food tray of FIG. 1.

FIG. 7 shows in greater detail the exterior structure of the female element 26. As will be discussed hereinafter with respect to FIGS. 8 and 9, important features of the female element 26 are the ribs 62 and the closed end surface 74 thereof.

Figure 8:
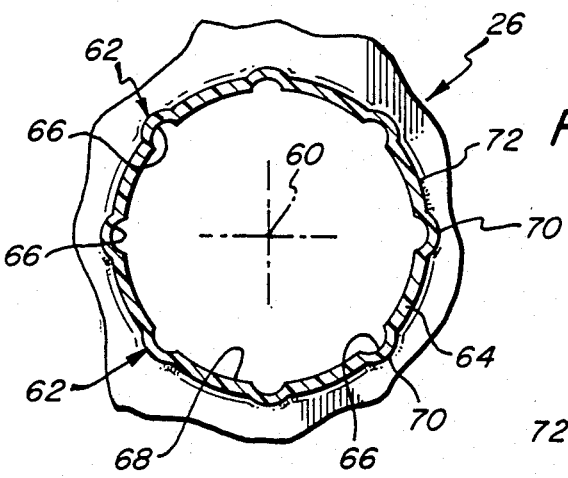
FIG. 8 is a cross-sectional view taken substantially along the plane indicated by line 8—8 of FIG. 7.

FIG. 8 shows in detail a cross section of the female element 26. The element is substantially cylindrical in cross section, having an axis 60 running into the drawing, an inside diameter, such as 0.375 inches, and a wall thickness, such as 0.007 inches.

Outwardly-projecting ribs 62 are formed in the wall 64 of the female element 26 and extend axially (longitudinally) substantially from the open end of the element to its closed end 74. The ribs are preferably semicircular in cross section, their centers of curvature being evenly spaced about the inner side wall surface 68 of the female element 26. The ribs 62 have a thickness, such as 0.007 inches and a diameter such as 0.012 inches. As is evident, the ribs form axially-extending voids, or channels 66 on the inside surface 68 of the wall 64, and axially-extending splines, or ridges 70 on the outside surface 72 of the wall 64.

The ribs 62 enhance the axial stiffness of the wall 64, and hence of the overall element 26. Thereby, closing pressure applied to the closed end of the element 26 is more effectively transmitted to the base (opening) of the female element whereat it is required to effect the snap fit of the annular rim at the opening of the female element over the enlarged diameter portion at the closed end of the male element.

The ribs 62 further facilitate the snap fit of the female element 26 over the male element 24 in that the channels 66 allow air to escape from within the female element during closing. In this regard, the ribs preferably extend past the annular rim formed in the opening of the female element to the annular mouth thereof. Without the ribs, air would be trapped by the mating cylindrical fit of the male and female elements and would ten to increase the closing pressure required to be applied to the female element. Thus, the ribs 62 operate to alleviate deformation of the female element in two ways, by increasing its axial stiffness and by allowing air to escape during closing.

These advantageous features of the ribs 62, either alone or in combination with the previously described lands 28, have been found to provide a much more facile closure between the male and female elements than the structure described in the aforementioned U.S. Pat. No. 4,576,330. Experimentation with the rib-modified structure disclosed herein has also shown that the fitting together of the male and female elements is much more tolerant of axial misalignments between the male and female elements, even without the benefit of the lands.

The number of ribs 62 is preferably eight, evenly distributed about the circumference of the female element 26. It has been found that as few as six ribs function effectively, that four ribs tends to be too few with regard to enhancing the stiffness of the female element around its entire circumference, and that ten ribs tends to be too many in that a significant portion of the inside cylindrical surface of the female element begins to be "lost" to the channels 66 created by the ribs. (Of course, having at least one rib is essential for relieving air from the female element.)

The dimension of the ribs has also been found to be somewhat critical. With the exemplary dimensions stated herein, the "voids" created by the ribs reduce the cylindrical inside surface area of the female element by approximately only 20%. Five percent would be considered a minimum for allowing air to escape, while 25% would be considered a maximum.

It has also been found that ribs that are triangular in cross section, such as forming equilateral triangles, rather than semicircular as discussed, are equally effective in providing increased stiffness and air "venting".

In light of the great benefit derived from the addition of ribs 62 to the female element 26, so much in fact that the lands 28 could possibly be eliminated, further experimentation was performed to determine whether the structural integrity (resistance to deformation) of the female element 26 could be further enhanced. It was discovered that when applying pressure to the closed end of a female element 26 not having the ribs, deformation began at the closed end, collapsing the end surfaced. This tends to initiate the deformation of the cylindrical shape of the female element, particularly its circular cross section, and more particularly, the circular shape of the annular rim at the opening of the female element. This empedes the mating snap-fit action of the male and female elements, which causes more pressure to be applied, which results in more deformation.

The inventor has discovered that the aforementioned deformation of the female element can be alleviated by modifying the end surface of the female element.

Figure 9:
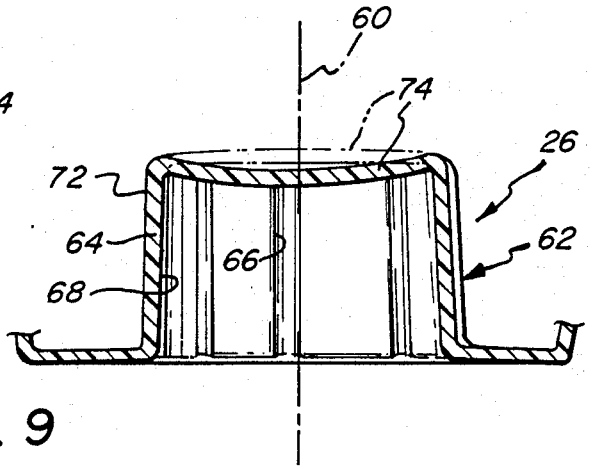
FIG. 9 is a cross-sectional view taken substantially along the plane indicated by line 9—9 of FIG. 7.

FIG. 9 shows in cross-section the female element 26. Again, the female element 26 is essentially cylindrical having a side wall 64, an open end and an end, opposite the open end, closed off by an end surface 74. Whereas in the aforementioned U.S. Pat. No. 4,576,330, the closed end surface of the female element was flat, herein the end surface 74 is concave, indented towards the opening of the female element. It has been found, with a concave end surface 74, that pressure applied to the closed end of the female element (by a user's thumb) is applied more directly and effectively to the side wall of the female element, thereby avoiding the aforementioned deformation problems associated with application of pressure at the center of the end surface. This is an especially useful feature when employed in conjunction with the ribs 62. Of course, the height of the male element 24 must be selected in light of the dimension of the depressed closed end surface 74 of the female element 26 to ensure a fit.

This advantageous feature of the concave end surface 74, either alone or in combination with the previously described ribs 62 and/or lands 28, has been found to improve the effectiveness of closing the male and female elements by helping to avoid deformation.

Furthermore, when the concave end surface feature is used without the ribs, air pressure otherwise tending to be trapped within the female element, thereby resisting insertion of the male element, will cause the concave end surface 74 to flex outwardly (towards being flat), thereby alleviating the previously discussed air entrapment problem.

Returning to the criticality of the ribs 62, insofar as the disclosed advantages thereof are concerned, it is essential to have at least one longitudinal rib 62 forming a channel 66 so that air will not be trapped upon closure of the male and female elements 24 and 26. At least two ribs evenly spaced about the side wall of the female element are required to have circumferentially symmetry, which bears upon load distribution about the side wall of the female element 26. Four ribs borders on being an acceptable number of ribs, insofar as distributing ribs about the circumference of the female element is concerned, but with four ribs the ribs must have a large dimension in order to cover an angular range of circumferential positions at which an applied load will be carried predominantly by the ribs, rather than by the side wall. For instance, four evenly spaced ribs, spanning about 20 degrees of side wall circumference each, leaves about 70 degrees of side wall circumference between each adjacent pair of ribs that is not structurally reinforced by a rib. Furthermore, these four ribs, in aggregate, reduce the circumferential (cylindrical) contact (inside side wall) area of the female element by approximately 25%. By contrast, in the preferred embodiment shown herein (e.g., in FIG. 8), eight ribs 62 are evenly disposed at every 45 degrees about the side wall, and each rib spans approximately 10 degrees, such as 5–15 degrees, of circumference. This means that there is only about 35±5 degrees of side wall circumference between each adjacent pair of ribs that is not structurally reinforced by a rib. Furthermore, this significant advantageous distribution of ribs about the side wall of the female element can be achieved while maintaining the reduction in cylindrical contact area of the female element by only about 25%.

A similar advantage of evenly distributing the closing force applied to the female element at several circumferential positions about the female element, while minimizing the range of positions at which there are no ribs and while maintaining the reduction in cylindrical contact area to a minimum is derived from six ribs of 5–15 degrees each, leaving only about 45±5 degrees of side wall circumference between each adjacent pair of ribs that is not structurally reinforced by a rib. Furthermore, six ten degree ribs would reduce the cylindrical contact area in the female element by only about 20%.

As mentioned before, the lands 28, depressed end surface 74 and ribs 62 all contribute to the structural integrity of the female element 26 which is a vital concern in both the initial and repeated interlocking of the female element 26 male member 24. Although each has its own benefit, they function quite well in concert with one another, in various combinations thereof.

Figure 1:
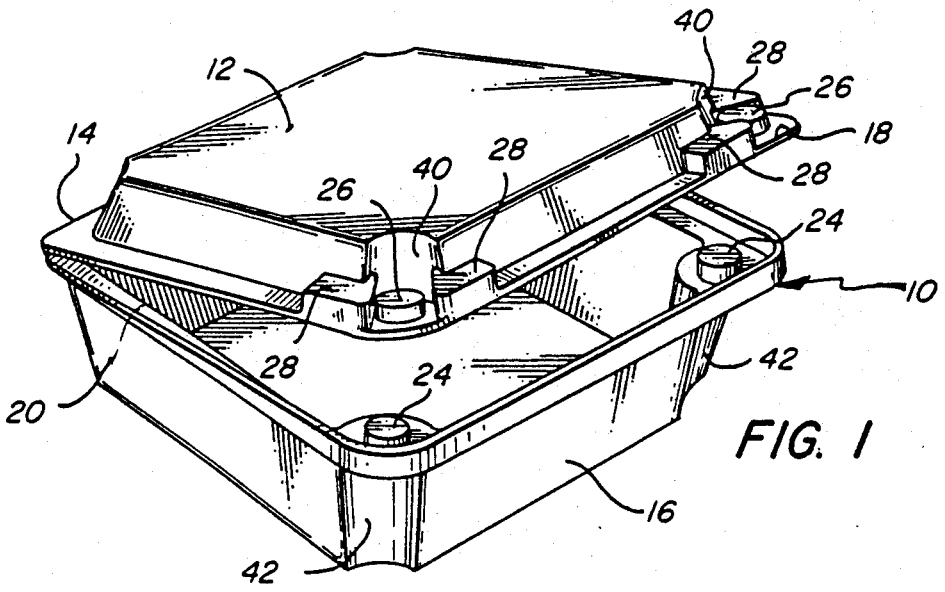
FIG. 1 is a perspective view of one form of an open food tray of the present invention which is provided with a lockable hinged lid.
Figure 2:
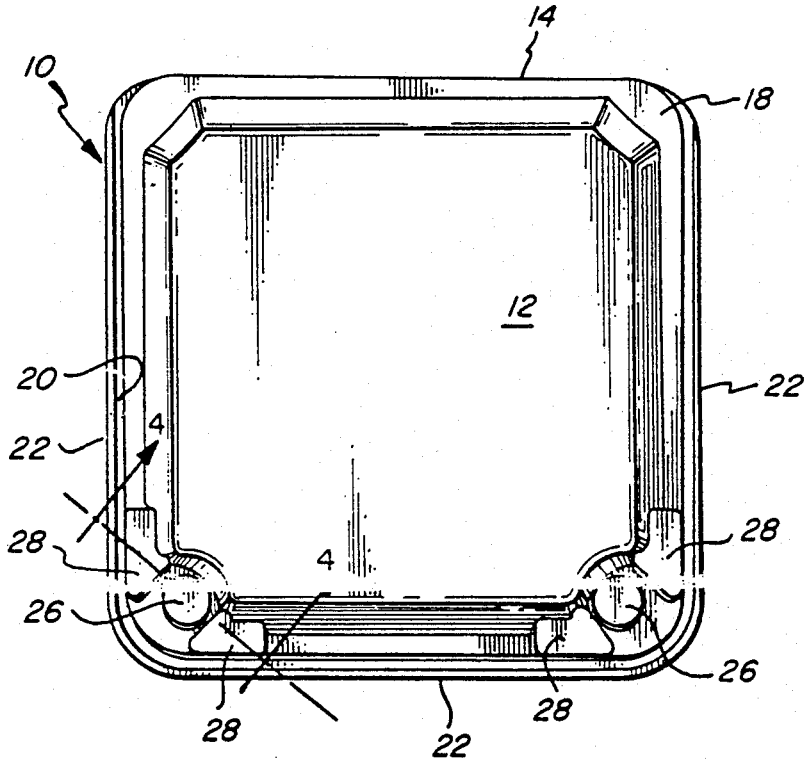
FIG. 2 is a top plan view of the lidded food tray of FIG. 1.
Figure 10:
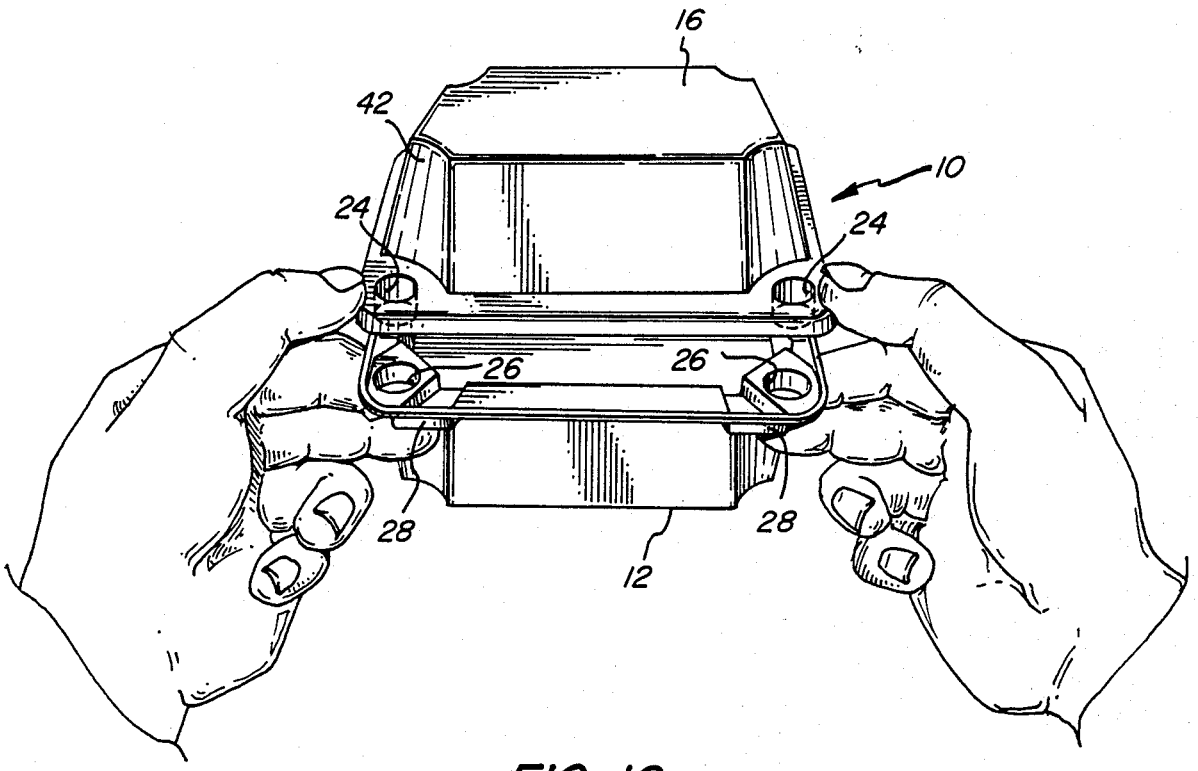
FIG. 10 is a perspective view of the food tray of FIG. 1, as employed upside down from what is shown in FIG. 1.

FIG. 10 shows the tray 10 of FIG. 1 as employed "upside down". It is felt that some users may prefer to use their thumbs at the base of the male element 24 while urging their first two fingers against the lands 28 adjacent the female element 26, as shown. This would seem to better direct closing pressure to the lands 28, rather than to the closed end (not visible) of the female element 26. As mentioned hereinbefore, when the container 10 is employed in this manner, the female elements 26 and lands 28 are disposed "downward" around the periphery what has been heretofore referred to as the "lid", but which is now the lower or "tray" portion of the container. Similarly, the male elements 24 formerly considered to be disposed about the "tray" portion of the container are, in FIG. 10, disposed about the periphery of what would now be considered the "lid" portion.

What is claimed is:

1. A container for carrying food comprising:

a tray portion, a lid portion directly hinged to the rear of said tray portion for movement towards and away from said tray portion to open and close the same, and means for locking said lid portion to said tray portion, said locking means including:

a horizontal flange extending around the periphery of said tray portion, a horizontal flange extending around the periphery of said lid portion adapted to be seated on the horizontal flange of said tray portion, one or more upright male elements extending upwardly from said horizontal flange on said tray portion towards said lid portion, one or more upright female elements extending upwardly from said horizontal flange on the periphery of said lid portion in positions corresponding to those of said one or more upright male elements, each of said one or more female elements having an open end for receiving one of said one or more upright male elements in interlocking engagement as said lid portion is folded over said tray portion in a closed position, and each of said one or more female elements including one or more ribs disposed in the side wall of said female element and extending substantially to the open end thereof, and raised lands extending upwardly from said horizontal flange on the periphery of said lid portion and being discrete from said one or more female elements, said lands being provided on opposite sides of and adjacent to each of said one or more upright female elements on said horizontal flange of said lid portion.

2. The container of claim 1 wherein said lid portion and tray portion are thermoformed from plastic in one integral piece.

3. The container of claim 1 wherein said lid portion and tray portion are substantially square in plane elevation and said male and female elements are located at opposite front corners of said lid and tray portion flanges.

4. The container of claim 1 wherein said lid portion and tray portion are substantially rectangular in plane elevation and said male and female elements are located at opposite front corners and in the center of said lid and tray portion flanges.

5. The container of claim 1 wherein each of said one or more ribs is semicircular in cross section.

6. The container of claim 1 wherein each of said female elements includes eight ribs.

7. The container of claim 1 wherein each of said one or more upright female elements is substantially cylindrical with an axis, and has a closed end surface opposite said open end.

8. The container of claim 7 wherein each of said one or more ribs of each of said one or more female elements extends substantially to the closed end surface of said female element.

9. The container of claim 7 wherein said closed end surface is indented towards said open end.

10. A container for carrying food comprising:

a tray portion, a lid portion directly hinged to the rear of said tray portion for movement towards and away from said tray portion to open and close the same, and means for locking said lid portion to said tray portion, said locking means including:

a horizontal flange extending around the periphery of said tray portion, a horizontal flange extending around the periphery of said lid portion adapted to be seated on the horizontal flange of said tray portion, one or more upright male elements extending upwardly from said horizontal flange on said tray portion towards said lid portion, one or more upright female elements extending upwardly from said horizontal flange on the periphery of said lid portion in positions corresponding to those of said one or more upright male elements, each of said one or more female elements having an open end for receiving one of said one or more upright male elements in interlocking engagement as said lid portion is folded over said tray portion in a closed position and having a closed end surface opposite said open end, said closed end surface being indented towards said open end, and raised lands extending upwardly from said horizontal flange on the periphery of said lid portion and being discrete from said one or more female elements, said lands being provided on opposite sides of and adjacent to each of said one or more upright female elements on said horizontal flange of said lid portion.

11. The container of claim 10 wherein said lid portion and tray portion are thermoformed from plastic in one integral piece.

12. The container of claim 10 wherein said lid portion and tray portion are substantially square in plane elevation and said male and female elements are located at opposite front corners of said lid and tray portion flanges.

13. The container of claim 10 wherein said lid portion and tray portion are substantially rectangular in plane elevation and said male and female elements are located at opposite front corners and in the center of said lid and tray portion flanges.

14. The container of claim 10 wherein said closed end surface of each of said one or more female elements is concave.

15. The container of claim 10 wherein each of said one or more female elements includes one or more ribs disposed in the side wall of the female elements and extending to the open end thereof.

* * * * *